US005970305A

United States Patent [19]

Shin

[11] Patent Number: 5,970,305

[45] Date of Patent: Oct. 19, 1999

[54] ELECTROPHOTOGRAPHIC APPARATUS HAVING A FILM FOR SEPARATING PRINTED MEDIA FROM A PHOTOCONDUCTIVE DRUM

[75] Inventor: Sang-Yob Shin, Suwon, Rep. of Korea

[73] Assignee: SamSung Electronics Co., Ltd., Kyungki-do, Rep. of Korea

[21] Appl. No.: 08/910,217

[22] Filed: Aug. 13, 1997

[30] Foreign Application Priority Data

Aug. 13, 1996 [KR] Rep. of Korea ..... 96-33585

[51] Int. Cl.[6] ..... G03G 15/00

[52] U.S. Cl. ..... 399/398; 271/312; 271/900

[58] Field of Search ..... 399/176, 397–399; 271/306–308, 311–313, 900

[56] References Cited

U.S. PATENT DOCUMENTS

| | | | |
|---|---|---|---|
| 4,119,307 | 10/1978 | Hamaker | 271/313 |
| 4,119,308 | 10/1978 | Hamaker | 271/313 |
| 4,974,032 | 11/1990 | Hara et al. | 399/315 |
| 5,138,381 | 8/1992 | Masaki et al. | 399/159 |
| 5,331,952 | 7/1994 | Ishii et al. | 271/900 X |
| 5,517,289 | 5/1996 | Ito et al. | 399/176 X |
| 5,537,193 | 7/1996 | Hasegawa et al. | 399/398 |
| 5,587,774 | 12/1996 | Nagahara et al. | 399/150 |
| 5,617,197 | 4/1997 | Kawabata et al. | 399/398 |

*Primary Examiner*—William Royer
*Attorney, Agent, or Firm*—Robert E. Bushnell, Esq.

[57] ABSTRACT

An electrophotographic development system preventive of a rolling of paper on a photosensitive drum includes a charging roller for charging the surface of the photosensitive drum with high voltage by a rotation with the photosensitive drum, an exposure unit for producing an electrostatic latent image on the charged part of the photosensitive drum, a developing roller having a thin and uniform toner layer through which the latent image on the photosensitive drum passes to be developed into a visible image, and a transfer roller for transferring the image on a paper, whereby to compulsorily separate the paper rolling up the photosensitive drum.

17 Claims, 5 Drawing Sheets

ELECTROPHOTOGRAPHIC APPARATUS HAVING A FILM FOR SEPARATING PRINTED MEDIA FROM A PHOTOCONDUCTIVE DRUM

CLAIM OF PRIORITY

This application makes reference to, incorporates the same herein, and claims all benefits accruing under 35 U.S.C. §119 from an application for *Electiophotographic Development System Preventive of Rolling of Paper on Photosensitive Drum* earlier filed in the Korean Industrial Property Office on Aug. 13, 1997 and there duly assigned Ser. No. 33585/1996.

FIELD OF THE INVENTION

The present invention relates to an electrophotographic development system such as laser printer and, more particularly, to an electrophotographic development system using polymerized toner whereby to prevent a rolling of paper on a photosensitive drum.

DISCUSSION OF RELATED ART

The use of paper strippers in electrophotography has been demonstrated in U.S. Pat. No. 5,537,193 for an *Image Forming Apparatus With Recording Sheet Separating Device* to Hasegawa et al. and U.S. Pat. No. 4,974,032 for a *Paper Separation Charger for Use in Electrophotographic Copier and the Like* to Hara et al. Although a gap exists between the pawl and the roller in Hasegawa et al, the paper stripper is for a transfer roller and not for the photosensitive drum. In Hara et al, no gap is formed between the stripper and the roller, damaging the results in the electrophotographic process. What is needed is a paper stripper for a photosensitive drum that does not make contact with the photosensitive drum but prevents paper from becoming wrapped up around the photosensitive drum.

SUMMARY OF THE INVENTION

An object is to provide an electrophotographic development system preventive of a rolling of paper on a photosensitive drum by separating the paper from the drum.

Another object is to provide a paper stripping pawl that does not come into contact with the photosensitive drum when stripping paper from the photosensitive drum.

To achieve these and other advantages and in accordance with the purpose of the present invention, as embodied and broadly described, an electrophotographic development system preventive of a rolling of paper on a photosensitive drum includes a charging roller for charging the surface of the photosensitive drum with high voltage by a rotation with the photosensitive drum, an exposure unit for producing an electrostatic latent image on the charged part of the photosensitive drum, a developing roller having a thin and uniform toner layer through which the latent image on the photosensitive drum passes to be developed into a visible image, and a transfer roller for transferring the image on a paper, whereby to compulsorily separate the paper rolling up the photosensitive drum.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
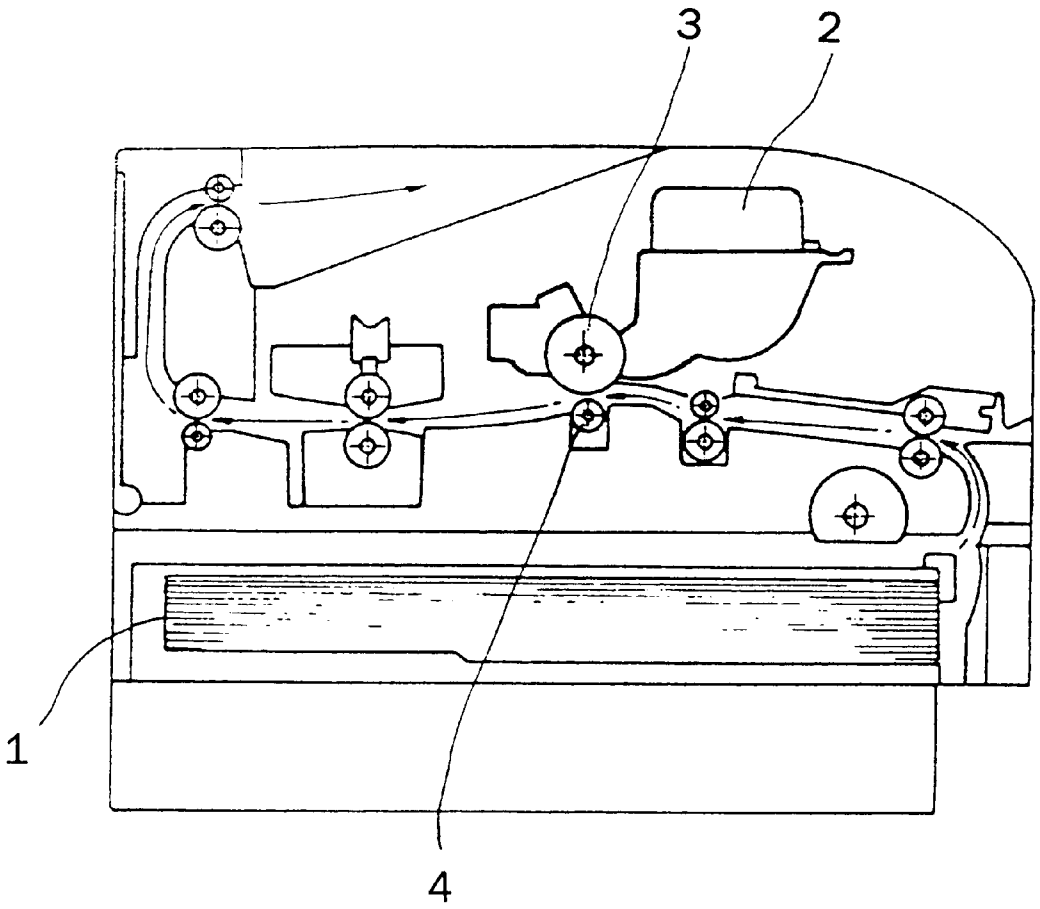
FIG. 1 is a sectional view of a product provided with an electrophotographic development system.

In a general electrophotographic development system, as shown in FIG. 1, paper 1 passes between a photosensitive drum 3 positioned under an exposure unit 2, and a transfer roller 4. Development systems are largely divided into two types by toners used—pulverized or polymerized toner.

Figure 2:
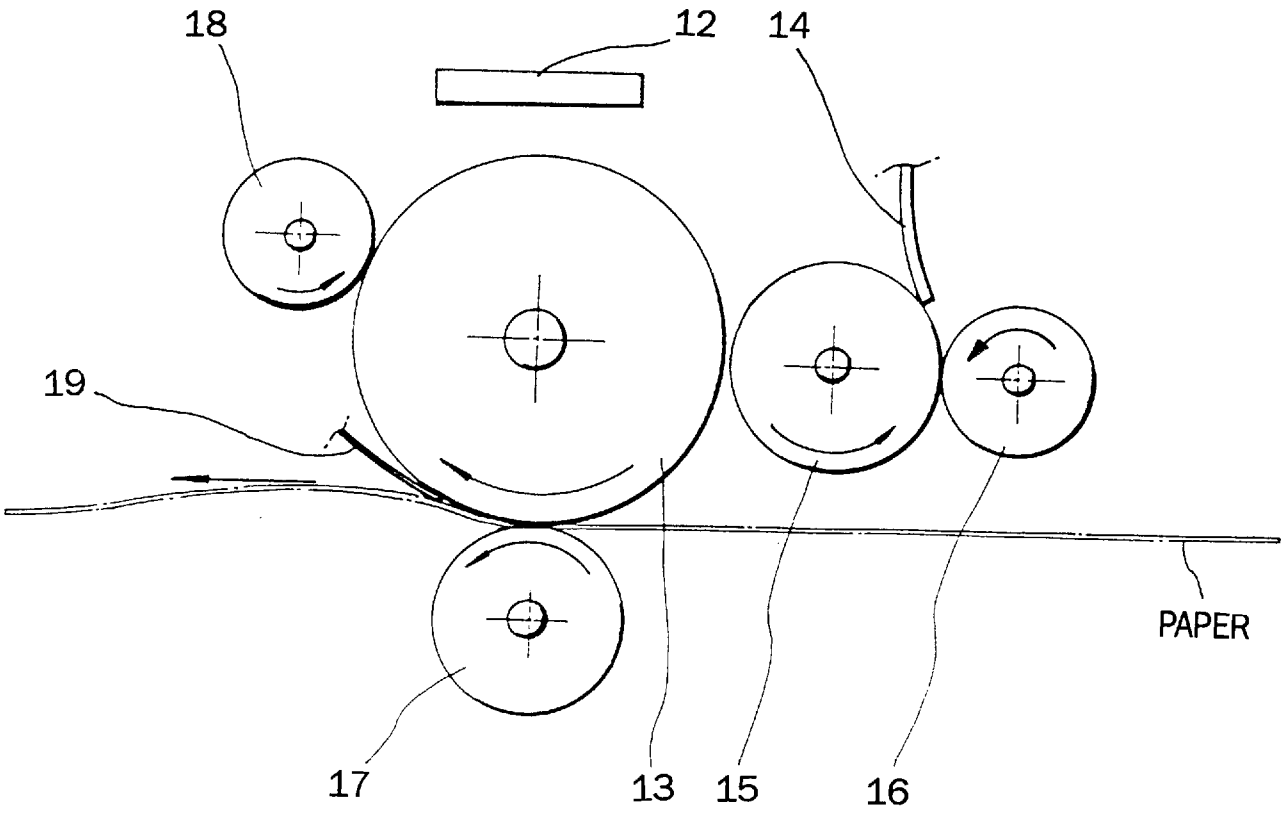
Fig. 2 (Conventional Art)
FIG. 2 is a schematic of a conventional development system using pulverized toner.

FIG. 2 shows a development system using the pulverized toner, comprising an exposure unit 12, a photosensitive drum 13 located under the exposure unit 12, a developing roller 15 having a blade 14 on one side of the photosensitive drum 13, and a feeding roller 16. The developing roller 15 is alternatively in contact with the photosensitive drum 13. The development system further comprises a transfer roller 17 located under the photosensitive drum 13, a charging roller 18, and a cleaning blade 19, arranged in the direction of discharging papers.

The development system using the pulverized toner can prevent the paper such as ordinary or vellum paper from being rolled up the photosensitive drum 13 because the paper can be caught in the cleaning blade 19 used to clean the toner.

Figure 3:
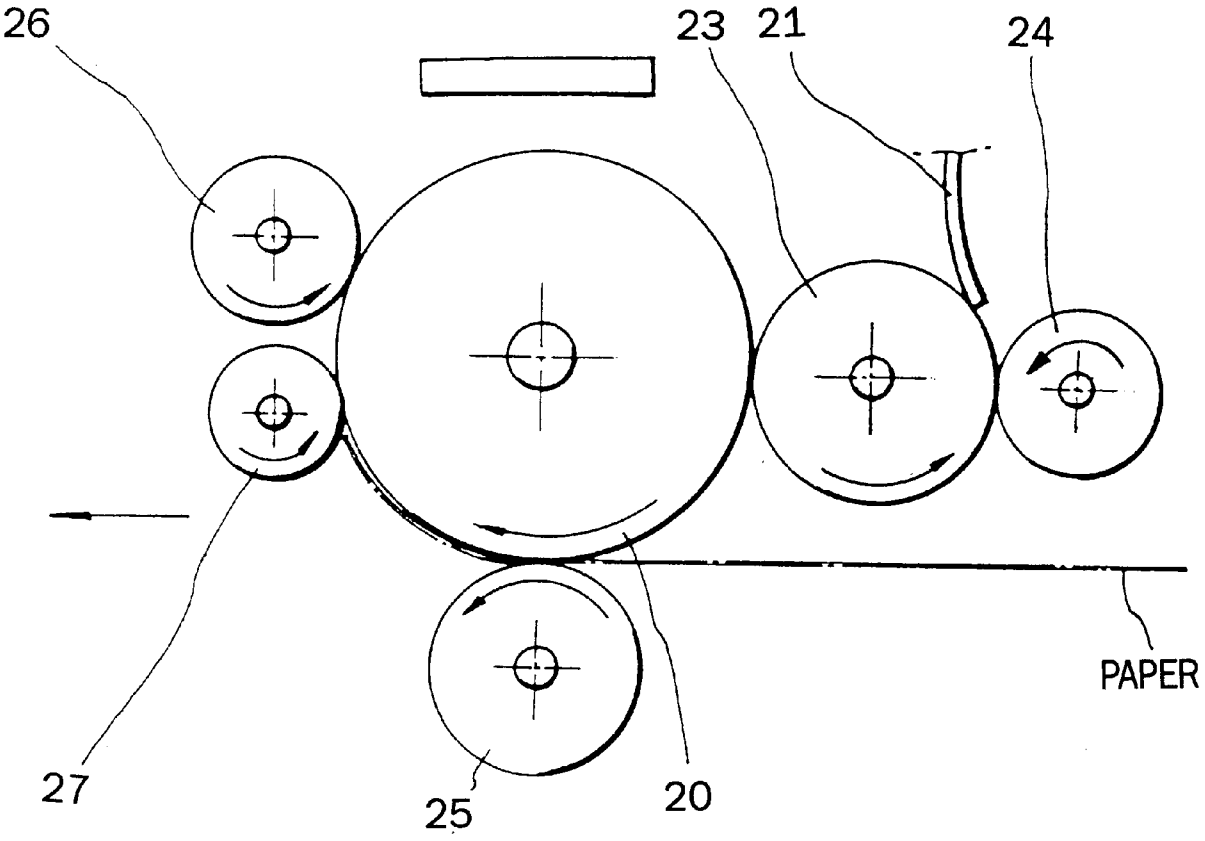
Fig. 3 (Conventional Art)
FIG. 3 is a schematic of a conventional development system using polymerized toner.

Contrary to the above case, the development system using the polymerized toner is not preventive of a rolling of paper. FIG. 3 is a schematic of a development system using the polymerized toner. Referring to FIG. 3, a developing roller 23 and a feeding roller 24 cleaned by a blade 21 are arranged in the reverse direction of feeding papers to a photosensitive drum 20 having a transfer roller 25 thereunder. The system further comprises a charging roller 26 and a cleaning roller 27 arranged in the direction of discharging a paper. The cleaning roller 27 is to clean the disused toner off the photosensitive drum 20.

The residual toner on the photosensitive drum is difficult to remove by using the cleaning blade for the development system using the pulverized toner. The toner tends to get into the cleaning blade to cause a damage on the photosensitive drum and produce stroke lines on the image. Thus, the development system using the polymerized toner is required to have the cleaning roller to eliminate the disused toner.

For highly charged paper such as ordinary or vellum paper, the leading edge passing through the photosensitive drum and transfer roller may be stuck to and rolled up on the photosensitive drum, which results in a deterioration of the product's reliability. The specification for paper used in a laser printer is usually 60~130 g/cmm. Such a rolling of paper is a more serious problem with formalized paper whose top edge is stained with an adhesive.

Figure 4:
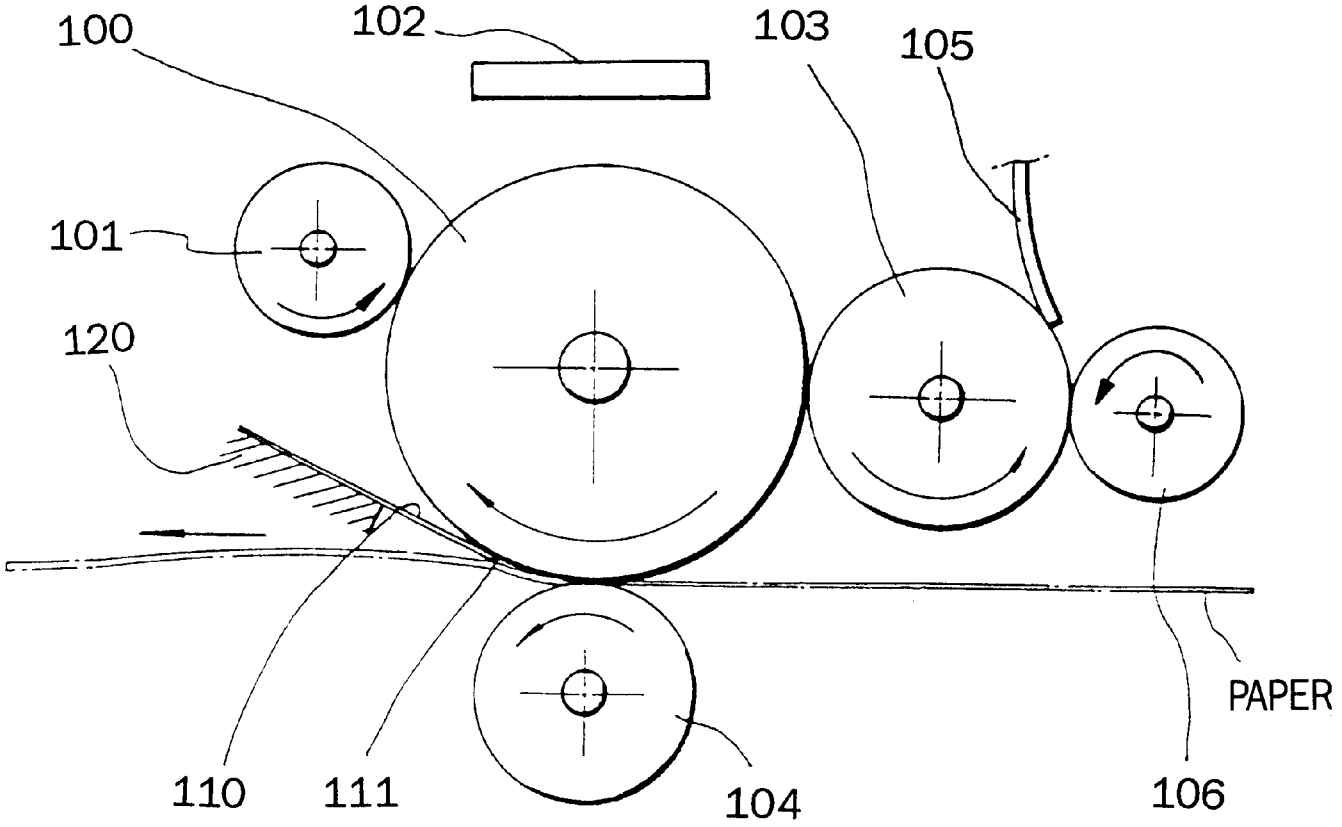
FIG. 4 is a schematic of a development system using polymerized toner in accordance with the present invention.

FIG. 4 illustrates the basic construction of an electrophotographic development system using polymerized toner according to the present invention. Referring to FIG. 4, a charging roller 101 makes the surface of a photosensitive drum 100 uniformly charged with high voltage by a rotation with the photosensitive drum 100. To produce an electrostatic latent image on the charged part of the photosensitive drum 100, an exposure unit 102 receives a digital signal from a computer and converts it into a light signal.

Passing through the thin and uniform toner layer deposited on a developing roller 103, the latent image produced on the photosensitive drum 100 becomes visible. The toner is transferred from the charged surface of the photosensitive drum 100 to the paper, then fused to the paper by a fixing device (not shown). The developing roller 103 has a blade 105 and a feeding roller 106 located on one side thereof.

The electrophotographic development system according to the present invention further comprises a compulsory paper separator between a transfer roller 104 and the charging roller 101. The compulsory paper separator is preferably an urethane seal (film) which is fixed to a frame 120 with the leading edge 111 positioned towards the transfer roller 104. It is desirable to give a designated angle of inclination between 23 and 27 degrees with respect to the path of the paper conveyance for the urethane seal 110 for the purpose of an effective separation of the paper from rolling up on the photosensitive drum 100. Such an inclination of the urethane seal 110 enhances the internal force of the seal 110 that is strong enough to surpass the turning effect and tenacity of the paper rolling up on the photosensitive drum 100.

The leading edge 111 of the urethane seal 110 must not contact the photosensitive drum 100 otherwise a residual toner on the drum 100 should get in the urethane seal to thereby cause a stroke line on the image. Between the leading edge 111 of the urethane seal 110 and the photosensitive drum 100 is a clearance of about 0.1 $\mu$. The urethane seal 110 must not be so thick as to jam the paper compulsorily separated from the photosensitive drum 100. The thickness of the urethane seal 110 is preferably less than about 0.2 mm.

Figure 5:
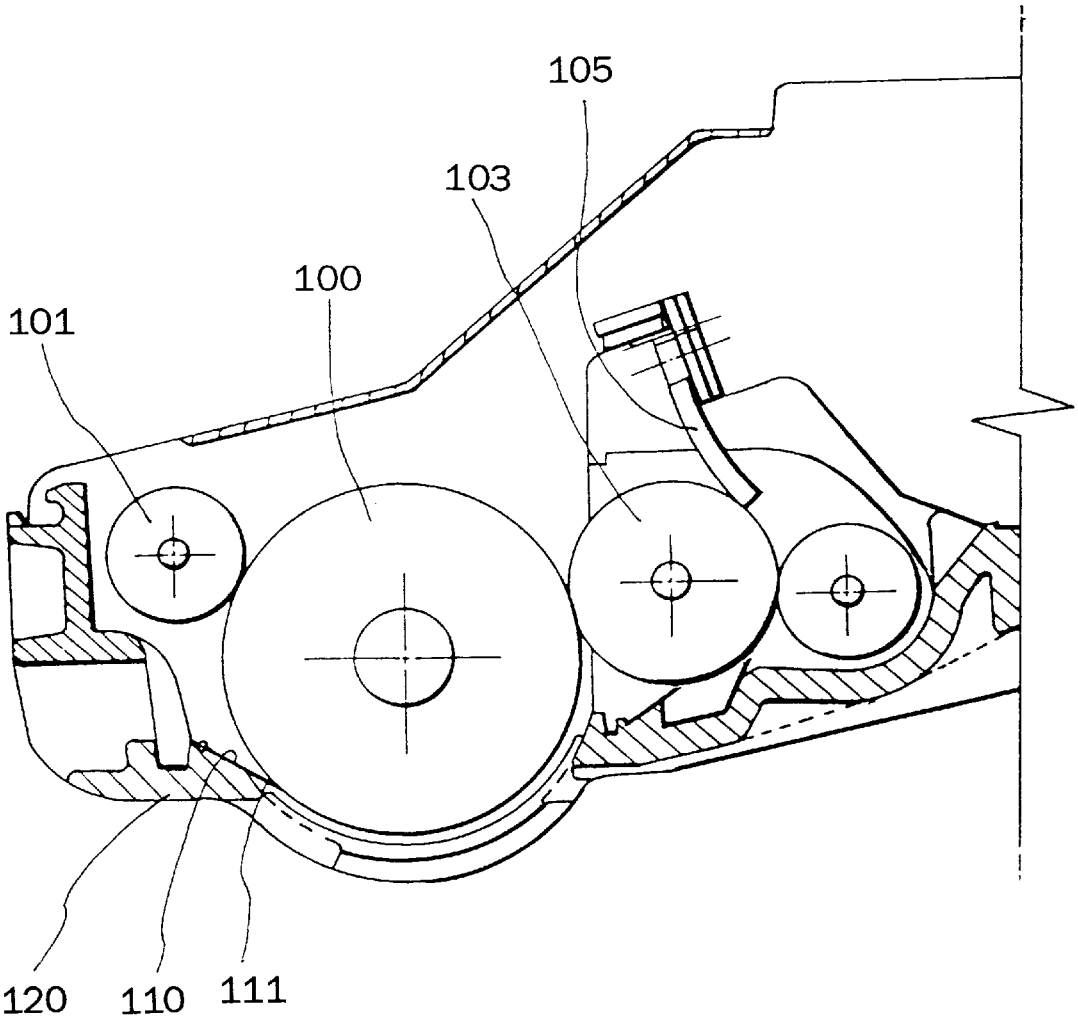
FIG. 5 shows the electrophotographic development system using polymerized toner, employing a compulsory paper separator in accordance with the present invention.

FIG. 5 shows an electrophotographic development system using polymerized toner, employing a compulsory paper separator in accordance with the present invention. Referring to FIG. 5, the whole body of the urethane seal 110 but its leading edge 111 is fixed fast to the frame 120 in order for the paper to be separated without a trembling of the leading edge 111 under a paper separation force. Accordingly, the present invention makes it possible to compulsorily separate the paper from rolling up onto the photosensitive drum in a development system using polymerized toner. The present invention can separate the paper from the photosensitive drum without affecting the image produced. As a result, the present invention shows a drastic enhancement in the products reliability because it makes it possible to separate paper including formalized paper having an adhesive on the top end thereof or other papers out of standard specification.

It will be apparent to those skilled in the art that various modifications and variations can be made in the electrophotographic development system preventive of a rolling of paper according to the present invention without departing from the spirit or scope of the invention. Thus, it is intended that the present invention cover the modifications and variations of this invention provided they come within the scope of the appended claims and their equivalents.

What is claimed is:

1. An electrophotographic development system comprising:

a charging roller for charging the surface of a photosensitive drum with high voltage;

an exposure unit for producing an electrostatic latent image on said surface of the photosensitive drum;

a developing roller having a thin and uniform toner layer, said developing roller transferring said toner onto the photosensitive drum to develop a visible image;

a transfer roller for transferring said visible image onto a paper; and a paper separating means located between said transfer roller and said charging roller, said paper separating means comprising an urethane film;

said urethane film separating said paper from said photosensitive drum when said paper has become attached to said photosensitive drum.

2. The electrophotographic development system as defined in claim 1, further comprised of said urethane film having a thickness of less than approximately 0.2 millimeters.

3. The electrophotographic development system as defined in claim 1, wherein the urethane film is fixed to a frame, said frame having an inclination.

4. The electrophotographic development system as defined in claim 3, wherein the frame supports said urethane film at an angle of inclination of approximately between 23 to 27 degrees relative to a paper path.

5. The electrophotographic development system as defined in claim 1, wherein the urethane film has a leading edge positioned towards the transfer roller.

6. The electrophotographic development system as defined in claim 1, wherein a leading edge of the urethane film is spaced apart from the photosensitive drum with a clearance of about 0.1 micrometers.

7. An electrophotographic development system, comprising:

a paper conveyance path;

a photosensitive drum having a surface;

a charging roller for charging the surface of said photosensitive drum with a high voltage;

an exposure unit for producing an electrostatic latent image on the charged surface of said photosensitive drum;

a developing roller having a thin and uniform toner layer that is transferred to said photosensitive drum to be developed into a visible image;

a transfer roller for transferring the visible image onto a paper from said photosensitive drum;

a paper stripper located between said transfer roller and said charging roller for removing paper that has become attached to said photosensitive drum, said paper stripper comprising an urethane film; and said urethane film causing said paper to remain on said paper conveyance path.

8. The electrophotographic development system of claim 7, further comprising a frame for supporting said paper stripper.

9. The electrophotographic development system of claim 8, said paper stripper forming an angle with the paper conveyance path.

10. The electrophotographic development system of claim 9, said angle being between approximately 23 to 27 degrees.

11. The electrophotographic development system of claim 7, further composed of said urethane film having a thickness of less than about 0.2 millimeters.

12. The electrophotographic development system of claim 11, said urethane film being separated from said photosensitive drum by about 0.1 micrometers.

13. An image forming apparatus, comprising:

a recording medium;

a paper path alone which said recording medium is transported;

a photoconductive drum for forming an image onto said recording medium; and an urethane film positioned proximate to said photoconductive drum for separating said recording medium from said photoconductive drum when said recording medium means has become attached to said photoconductive drum.

14. The image forming apparatus of claim 13, said urethane film having a thickness less than about 0.2 millimeters.

15. The image forming apparatus of claim 14, said urethane film being spaced about 0.1 micrometers from said photoconductive drum.

16. The image forming apparatus of claim 13, said urethane film being fixed to a frame, said frame forming an angle with said paper path.

17. The image forming apparatus of claim 16, said angle being approximately about 23 to 27 degrees.

* * * * *